United States Patent [19]

Murata et al.

[11] Patent Number: 4,576,840

[45] Date of Patent: Mar. 18, 1986

[54] PILE FABRIC HAVING SHRUNKEN PILE AND NON-SHRINKABLE PILE

[75] Inventors: Shouichi Murata, Takasago; Muneto Makiyama, Kobe; Takahiro Omoto, Takasago; Taizo Yasumoto, Kobe, all of Japan

[73] Assignee: Kanegafuchi Kagaku Kogyo Kabushiki Kaisha, Osaka, Japan

[21] Appl. No.: 690,905

[22] Filed: Jan. 14, 1985

[30] Foreign Application Priority Data

Mar. 27, 1984 [JP] Japan ..... 59-60083

[51] Int. Cl.[4] ..... D02G 3/00; D03D 27/00

[52] U.S. Cl. ..... 428/16; 428/89; 428/96; 428/97

[58] Field of Search ..... 428/16, 89, 96, 97

[56] References Cited

U.S. PATENT DOCUMENTS 4,340,631 7/1982 Endo et al. ..... 428/89

*Primary Examiner*—Marion C. McCamish

*Attorney, Agent, or Firm*—Sughrue, Mion, Zinn, Macpeak & Seas

[57] ABSTRACT

A pile composition comprising as pile fibers 20 to 98% by weight of shrinkable fibers which are at least 15% in shrinkage and up to 0.230 in coefficient of static friction between the fibers. The pile obtained is outstanding in appearance, hand and draping property.

5 Claims, No Drawings

PILE FABRIC HAVING SHRUNKEN PILE AND NON-SHRINKABLE PILE

BACKGROUND OF THE INVENTION

1. Field of the Invention

The present invention relates to a pile composition having a natural fur-like appearance and hand (draping property), and more particularly to a pile composition comprising as pile fibers shrinkable fibers which are adapted to have a coefficient of static friction between fibers of up to a specified value when shrunk to give a knitted or woven pile fabric having incorporated therein the shrinkable fibers and outstanding in appearance and draping property.

2. Description of the Prior Art

Conventional knitted or woven pile fabrics include artificial furs in which, to simulate the raised tufts of natural fur, the pile portion is usually formed by a blend of nonshrinkable fibers and shrinkable fibers which are relatively frictional or coarse, i.e. which have a great coefficient of static friction in view of spinnability, such that in appearance, the shrinkable fibers serve as down hairs and the nonshrinkable fibers as guard hairs. With such pile made of conventional shrinkable fibers, the shrinkable fibers intertwine or twine around nonshrinkable fibers when shrinking during shrinking treatment, with the result that when subsequently polished for the removal of crimps, the fibers, which are tightly entangled, are not effectively acted on except at the portion close to the surface of the pile. Thus, the tufts of the pile exhibit a very poor finish unlike natural furs. Moreover, the pile gives a feel of friction or has coarse hand. Further because the pile fabric is very low in drapeability, the garment made of the fabric does not smoothly fit to the body and appears awkward and exceedingly inferior to those made of natural fur.

SUMMARY OF THE INVENTION

An object of the present invention is to provide a pile composition which is outstanding in appearance, hand and draping property.

Other objects and advantages of the invention will become apparent from the following description.

We have succeeded in overcoming the above drawbacks with attention directed to the resistance between entangled fibers after the shrinking treatment before polishing because this resistance appears to be most responsible for the drawbacks. Stated more specifically, we have found that when the coefficient of static friction between shrunk fibers is small, the shrinking treatment of the knitted or woven pile fabric involves reduced resistance between entangled fibers, which facilitates the subsequent polishing treatment for the removal of crimps (polishing finish), consequently giving a pile fabric which has an attractive appearance and which is pliable with a soft feel and highly drapeable since the fibers of the shrunk pile are not tightly entangled. Based on this finding, we have accomplished the present invention.

DETAILED DESCRIPTION OF THE INVENTION

The present invention provides a pile composition comprising as pile fibers 20 to 98% by weight of shrinkable fibers having a shrinkage of at least 15% and a coefficient of static friction between the fibers of up to 0.230.

The pile composition of the present invention is characterized in that it comprises shrinkable fibers which are up to 0.230 in coefficient of static friction between the fibers. To obtain such a coefficient of static friction, it is necessary to deposit a smoothness imparting finishing agent on the surface of the shrinkable fibers. Preferred finishing agents are organopolysiloxanes, among which an epoxy- or amino-containing organopolysiloxane is more preferable. Such agents are used singly or in admixture.

Examples of organopolysiloxanes useful for the present invention are methylhydrogenpolysiloxane, methylvinylpolysiloxane, alkoxypolysiloxanes, epoxy-containing polysiloxanes and amino-containing polysiloxanes. An example of preferred epoxy-containing organopolysiloxane is one which is 300 to 500,000 cst in viscosity at 25° C. and 600 to 10,000 in epoxy equivalent. Further preferably, the aminocontaining organopolysiloxane is 50 to 500,000 cst in viscosity at 25° C. and 600 to 10,000 in amine equivalent. However, these examples are not limitative. Such an organopolysiloxane may be used in combination with one or at least two of other organopolysiloxanes and/or one or at least two of silanes including aminosilane, epoxysilane and mercaptosilane. When required, the siloxane finishing agent may be used conjointly with other finishing agents such as antistatic agent, water repellent, oil repellent, hand adjusting agent and SR treating agent.

The organopolysiloxane is deposited on the shrinkable fibers to be used in this invention, in an amount of 0.008 to 1.0% by weight, preferably 0.03 to 0.5% by weight, calculated as silicon atoms. The amount is determined suitably in accordance with the coefficient of static friction between the fibers after shrinkage. Generally when the amount of deposit is less than 0.008% by weight calculated as silicon atoms, the coefficient becomes greater, permitting marked entanglement of fibers and presenting difficulty in the polishing treatment, whereas if the amount exceeds 1.0% by weight, the fibers collect prominently when made into a pile to result in an impaired appearance, hence objectionable. In other words, if the coefficient of static friction after shrinkage is up to 0.230, the fibers as shrunk are less entangled and can therefore be polished easily to give a pile of good appearance. However, when the amount of organopolysiloxane deposited is over 1.0% by weight calculated as silicon atoms, the pile fibers tend to collect into clusters to impair the appearance of the fabric although the fabric can be polished satisfactorily.

The pile forming shrinkable fibers having the organopolysiloxane deposited thereon are prepared, preferably by treating the fibers with an emulsion of organopolysiloxane during the production process of the fibers. It is also possible to treat shrinkable staple fibers with the emulsion of organopolysiloxane. When the wet spinning process is used, for example, swollen fibers are treated with the organopolysiloxane emulsion before drying, then dried, heat-treated and thereafter rendered shrinkable by drawing. Alternatively, wet-spun fibers are dried and, when desired, are drawn and heat-treated, followed by treatment with the organopolysiloxane emulsion, whereupon the fibers are dried, heat-treated and thereafter made shrinkable by drawing. In either case, it is desired that the fibers be as low as up to 0.230 in the coefficient of static friction between the fibers prior to the shrinking treatment. Fibers obtained by the dry spinning process are treated similarly. Preferably, shrinkable fibers dry-spun by the usual process are treated with an emulsion of organopolysiloxane only or conjointly with a process stabilizing oily agent, then dried and heat-treated. On the other hand, when shrinkable staple fibers are used, the fibers may be treated with an emulsion of organopolysiloxane. When required, the staple fibers may be so treated after the fiber surface has been degreased. In this case, the treated shrinkable fibers are higher than those subjected to the shrinking treatment and heat treatment in the above coefficient of static friction. According to the present invention, therefore, the coefficient of static friction between the shrunk fibers is critical and should be up to 0.230.

The shrinkable fibers to be used for the present invention are thermoplastic high polymers, preferably acrylic synthetic fibers. Useful acrylic synthetic fibers are copolymers which comprise at least 30% by weight of acrylonitrile and which are prepared by copolymerizing acrylonitrile with at least one monoolefin monomer copolymerizable therewith. If the proportion of acrylonitrile is less than 30% by weight, the resulting pile fabric fails to have fur-like hand, feels adhesive, lacks in bulky feel, is therefore undesirable and further requires special conditions for shrinking treatment and polishing. Examples of suitable monoolefin monomers are acrylic esters, methacrylic esters, acrylic acid amide, methacrylic acid amide, mono- or di-alkyl-substituted compounds of such esters or amides, acrylic acid, methacrylic acid, itaconic acid, vinyl chloride, vinylidene chloride, vinyl acetate and like vinyl esters, vinylpyrrolidone, vinylpyridine, alkyl-substituted compounds of such pyrrolidone or pyridine, styrenesulfonic acid, allysulfonic acid, methallylsulfonic acid, p-methacryloyloxybenzenesulfonic acid, methacryloyloxypropylsulfonic acid, metal salts or amine salts of such sulfonic acids, etc. According to the invention, copolymerizable monomers are not limited definitely; conventional monoolefin unsaturated compounds are all usable insofar as they are copolymerizable with acrylonitrile.

The acrylic copolymer can be obtained by the usual vinyl polymerization process with use of a known compound as a polymerization initiator. Examples of useful initiators are peroxide compounds, azo compounds and redox compounds.

The acrylic copolymer is dissolved in an organic solvent such as acetone, acetonitrile, dimethylformamide, dimethylacetamide or dimethyl sulfoxide or in an inorganic solvent such as zinc chloride, nitric acid or rhodanate to obtain a spinning solution. Organic and/or inorganic pigments, such as titaniumdioxide and coloring pigments, and stabilizers, etc. which are effective for inhibiting rust, preventing discoloration and lightfastness can be incorporated into the solution, provided that the solution can be spun without trouble.

The spinning solution is extruded through a nozzle by the usual wet or dry spinning method, then drawn and dried, further followed by drawing and heat treatment when so required. The filament obtained is drawn to 1.2 to 4.0 times at 70° to 140° C., giving a shrinkable fiber. The shrinkable fiber should be at least 15%, preferably at least 20%, in shrinkage. The reason is that if fibers less than 15% in shrinkage are made into a finished knitted or woven pile fabric, the guard hair portion and the down hair portion will not be greatly different in pile height, thus failing to produce a distinct effect of different pile heights. The term "shrinkage" as herein used means the difference in length between a fiber before shrinking and the fiber after shrinking, expressed as a percentage of the orginal fiber length, the fiber being shrunk by treatment with steam at atmospheric pressure for 30 minutes, or by finishing treatment for knitted or woven pile fabric, or by 30 minute treatment under conditions similar to those of shrinking treatment.

The shrinkable fibers to be used are crimped so as to be amenable to the subsequent pile forming process, that is, so that the carded web or sliver can be spun or treated by a sliver knitting machine. Preferably the fiber has 2 to 15 crimps per inch, more preferably 4 to 12 crimps per inch (as measured according to JIS L-1015). However, the number of crimps is not limited particularly but is variable according to the blending ratio of shrinkable fibers and nonshrinkable fibers.

Thus, the pile composition of the invention is obtained which comprises as pile fibers 20 to 98% by weight, preferably 40 to 95% by weight, more preferably 50 to 90% by weight, of shrinkable fibers. As compared with compositions comprising conventional shrinkable fibers which are above 0.230 in coefficient of static friction between the fibers, the present pile composition is superior in the finished appearance and hand, especially draping property, of the knitted or woven pile fabric prepared therefrom. Such effects become more pronounced with an increase in the content of shrinkable fibers. On the other hand, if the amount of shrinkable fibers to be used for the invention as pile fibers is less than 20% by weight, the resulting knitted or woven pile fabric will not be greatly different from those incorporating conventional shrinkable fibers. Although the effects can be achieved remarkably even when the amount exceeds 98% by weight, the greatly diminished guard hair portion upsets the balance between the guard hairs and the down hairs to result in a reduced commercial value.

Even when pile forming shrinkable fibers are used in a high blending ratio unlike the conventional shrinkable fibers, the pile obtained is outstanding in both appearance and draping property, so that a wider variety of commercial products can be designed. For example, mink-simulating pile fabrics, which are conventionally difficult to make, can be prepared using shrinkable fibers in a high blending ratio. Further because shrinkable fibers are usable in high blending ratios, fabrics with a pile of multidimensional effect can be prepared with use of at least two kinds of shrinkable fiber materials which are different in shrinkage.

In the examples to follow, the properties of fiber specimens were determined and evaluated by the methods described below, and high piles were prepared by the process stated below.

(1) Coefficient of static friction

The coefficient of static friction between fibers was measured by a fiber friction coefficient tester according to the Röder method (product of Aoi Seiki Laboratory).

(2) Wet heat shrinkage

The length (Lw) of the specimen subjected to a load of 10 mg/d was measured before shrinking. The specimen was treated with steam at atmospheric pressure for 30 minutes for shrinking, then cooled to room temperature and checked for length (L'w) under a load of 10 mg/d. The shrinkage was calculated from the following equation.

$$\text{Shrinkage (\%)} = \frac{Lw - L'w}{Lw} \times 100$$

(3) Dry heat shrinkage

The dry heat shrinkage was determined in the same manner as the wet heat shrinkage except that the specimen was uniformly heated in an oven for shrinking. The shrinkage was calculated from the following equation wherein Ld is the length of the specimen before shrinking and L'd is that after shrinking.

$$\text{Shrinkage (\%)} = \frac{Ld - L'd}{Ld} \times 100$$

(4) Preparation of high pile

Shrinkable fibers and nonshrinkable fibers were blended together, conditioned and then treated by an opener and carding machine to obtain a sliver, which was subsequently knitted into a pile by a high-pile knitting (weaving) machine. The pile portion was sheared to a uniform pile length. An acrylic ester adhesive was thereafter applied to the rear side of the pile for back coating. Immediately before coating, steam was sprayed to the rear side to shrink the shrinkable fibers of the pile portion and give the adhesive coating improved adhesion. The pile was then heated at 130° C. for 10 minutes to dry the pile and also assure the shrinking effect. The pile was thereafter polished and sheared to obtain a finished high pile (5) Evaluation of appearance and hand of high pile The pile prepared by the process (4) was checked visually and by the touch by seven specialists for appearance and hand (draping property).

Examples are given below, in which the parts and percentages are by weight unless otherwise specified.

EXAMPLE 1

A copolymer (27 parts) composed of 48 parts of acrylonitrile, 51 parts of vinyl chloride and 1 part of sodium styrenesulfonate was dissolved in 73 parts of acetone to obtain a spinning solution. The solution was extruded into 40% aqueous solution of acetone at 25° C. through a spinneret having 6,000 holes with a diameter of 0.08 mm. The filaments were drawn to 1.5 times in 20% aqueous solution of acetone at 25° C. and then rinsed with water at 60° C. Subsequently the filaments were dipped in an emulsion of amino containing organopolysiloxane (3,000 in amine equivalent and 1,300 cst in viscosity at 25° C.) prepared with use of a nonionic surfactant, dried at 130° C., further drawn to 2.0 times at 100° C., treated with antistatic agent of the amphoteric type and thereafter crimped, giving shrinkable fibers having eventual fineness of 4.0 denier. The fibers were cut to a length of 38 mm. The fibers exhibited a wet heat shrinkage of 40.7%, dry heat shrinkage of 37.8% when treated at 130° C. for 30 minutes and coefficient of static friction of 0.143. A quantity of the shrinkable fiber material (80%) and 20% of "KANEKALON ®", RFM, 15d, 51 mm (product of Kanegafuchi Chemical Industry Co., Ltd.) were blended together and made into a high pile. The pile was sheared to a pile length of 18 mm after sliver knitting and to a pile length of 20 mm after polishing. As shown in Table 1, the high pile was excellent in both appearance and hand.

EXAMPLE 2

A quantity of the shrinkable fiber material (50%) prepared in Example 1 and 50% of "KANEKALON ®", RCL, 20 d, 51 mm (product of Kanegafuchi Chemical Industry Co., Ltd.) were blended together and made into a high pile in the same manner as in Example 1. As shown in Table 1, the high pile was excellent in both appearance and hand.

EXAMPLE 3

With the same spinning solution as used in Example 1 was uniformly admixed a dispersion of $TiO_2$ in acetone in an amount of 0.2 part, calculated as $TiO_2$, per 100 parts of the copolymer. The mixture was extruded into 40% aqueous solution of acetone at 25° C. through a spinneret having 6,000 holes with a diameter of 0.08 mm. The filaments were drawn to 1.8 times in 20% aqueous solution of acetone at 25° C., then rinsed with water at 60° C. and dried at 130° C. Next, the filaments were dipped in an emulsion of epoxy-containing organopolysiloxane (4,000 in epoxy equivalent and 1,500 cst in viscosity at 25° C.) prepared with use of a nonionic surfactant, then dried at 130° C., treated with an antistatic agent of the amphoteric type, thereafter crimped and dried at 80° C.

The filaments were drawn to 1.45 times by being passed over a heat roll at 125° C. in contact therewith and then crimped, affording shrinkable fibers having eventual fineness of 3.5 d. The fibers were cut to a length of 38 mm. The fibers exhibited a wet heat shrinkage of 32.7%, dry heat shrinkage of 31.3% when treated at 130° for 30 minutes and coefficient of static friction of 0.212. A quantity of the shrinkable fiber material (40%) and 60% of dyed cut fiber, "Verel ®", Type 212 Dull, 16 d, 51 mm (product of Eastman Kodak Company) were blended together and made into a high pile. The pile was sheared to a pile length of 20 mm after sliver knitting and to a pile length of 23 mm after polishing. As shown in Table 1, the pile was satisfactory in appearance and hand.

EXAMPLE 4

A copolymer composed of 85 parts of acrylonitrile, 14.3 parts of methyl acrylate and 0.7 part of sodium styrenesulfonate was prepared in dimethylformamide by solution polymerization. The copolymer solution was extruded into 50% aqueous solution of dimethylformamide through a spinneret having 6,000 holes with a diameter of 0.08 mm. The filaments were drawn to 2 times in 70% aqueous solution of dimethylformamide at 40° C., then rinsed with water at 50° C. and further rinsed with hot water at 90° C. to remove the dimethylformamide. Next, the filaments were dipped in the same organopolysiloxane emulsion as used in Example 1, dried at 130° C., further drawn to 2 times in hot water at 70° C., treated with an antistatic agent of the amphoteric type and thereafter crimped, giving shrinkable fibers having eventual fineness of 4.2 d. The fibers were cut to a length of 38 mm. The fibers exhibited a wet heat shrinkage of 40.7% and coefficient of static friction of 0.223. A quantity of the shrinkable fiber material (50%) and 50% of "KANEKALON ®", SL, 15 d, 51 mm (product of Kanegafuchi Chemical Industry Co., Ltd.) were blended together and made into a high pile. The pile was sheared to a pile length of 18 mm after sliver knitting and to a pile length of 20 mm after polishing. As shown in Table 1, the pile was satisfactory in appearance and hand.

EXAMPLE 5

The same spinning solution as used in Example 1 was extruded into 40% aqueous solution of acetone at 25° C. through a spinneret having 6,000 holes with a diameter of 0.08 mm. The filaments were drawn to 1.5 times in 20% aqueous solution of acetone at 25° C. and then rinsed with water at 60° C. Subsequently, the filaments were dipped in an emulsion of amino-containing organopolysiloxane (3,800 in amine equivalent and 800 cst in viscosity at 25° C.) prepared with use of a nonionic surfactant, then dried at 130° C., further drawn to 2.3 times at 120° C., heat-treated at 120° C. under tension, treated with an antistatic agent of the amphoteric type and crimped to obtain shrinkable fibers having eventual fineness of 3.1 d. The fibers were cut to a length of 38 mm. The fibers exhibited a wet heat shrinkage of 20.4% and coefficient of static friction of 0.171. A quantity of the shrinkable fiber material (70%) and 30% of "KANEKALON ®", RFM, 20 d, 51 mm (product of Kanegafuchi Chemical Industry Co., Ltd.) were blended together and made into a high pile. The pile was sheared to a pile length of 22 mm after sliver knitting and to a pile length of 30 mm after polishing. As shown in Table 1, the high pile exhibited distinctly different pile heights and outstanding draping property.

COMPARATIVE EXAMPLE 1

The same spinning solution as used in Example 1 was extruded into 40% aqueous solution of acetone at 25° C. through a spinneret having 6,000 holes with a diameter of 0.08 mm. The filaments were drawn to 1.5 times in 20% aqueous solution of acetone at 25° C. and then rinsed with water at 60° C. Subsequently, the filaments were dipped in an aqueous solution of nonionic surfactant, then dried at 130° C., further drawn to 1.6 times at 100° C., treated with an antistatic agent of the anion type and thereafter crimped, giving shrinkable fibers having eventual fineness of 3.0 d. The fibers were cut to a length of 38 mm. The fibers exhibited a wet heat shrinkage of 34.7%, dry heat shrinkage of 30.5% when treated at 130° C. for 30 minutes and coefficient of static friction of 0.342. A quantity of the shrinkable fiber material (15%) and 85% of "KANEKALON ®", RCF, 20 d, 51 mm (product of Kanegafuchi Chemical Industry Co., Ltd.) were blended together and made into a high pile. The same shearing conditions as in Example 1 were used. As shown in Table 1, the high pile had satisfactory hand (draping property) but exhibited a poor appearance unlike furs because of an insufficient amount of down hairs.

COMPARATIVE EXAMPLE 2

A quantity (50%) of the shrinkable fiber material prepared in Comparative Example 1 and 50% of "KANEKALON ®", RCF, 20 d, 51 mm (product of Kanegafuchi Chemical Industry Co., Ltd.) were blended together and made into a high pile in the same manner as in Comparative Example 1. Table 1 shows the result. The high pile had a down hair portion of high density, appeared felt-like, had poor hand (draping property) and in no way resembled furs.

COMPARATIVE EXAMPLE 3

A quantity (15%) of the shrinkable fiber material prepared in Example 1 and 85% of "KANEKALON R", RCL, 20 d, 51 mm (product of Kanegafuchi Chemical Industry Co., Ltd.) were blended together and made into a high pile in the same manner as in Example 1. Table 1 shows the result. Although having excellent hand, the high pile appeared to have a poor effect of different pile heights due to an insufficient amount of down hairs, thus showing little resemblence to natural furs. When evaluated generally from the viewpoint of commercial pile product, the pile was not acceptable as goods of different pile heights.

TABLE 1

| | Appearance[1] | Hand (draping property)[2] |
|---|---|---|
| Example 1 | A | A |
| Example 2 | A | A |
| Example 3 | B | B |
| Example 4 | B | B |
| Example 5 | A | A |
| Comp. Ex. 1 | C | B |
| Comp. Ex. 2 | C | C |
| Comp. Ex. 3 | C | A |

Note:
[1]The appearance of the high pile was evaluated according to the following criteria.
A: Excellent (having distinctly different pile heights to resemble natural furs, having down hair portion of high density, and polished with a good finish)
B: Good (inferior to A in at least one item)
C: Poor
[2]The hand (draping property) was evaluated according to the following criteria.
A: Excellent (pliable and smoothly fittable to the body)
B: Good
C: Poor

What is claimed is:

1. A woven or knitted pile fabric having a natural fur-like appearance and having a pile portion formed of a blend of 20 to 98% by weight of shrinkable fibers having a shrinkage of at least 15% and a coefficient of static friction between the shrunk fibers of up to 0.230, said shrinkable fibers having a smoothness imparting finishing agent on the surfaces thereof, and non-shrinkable fibers.

2. A pile composition as defined in claim 1 wherein the shrinkable fibers are acrylic synthetic fibers of a copolymer comprising at least 30% by weight of acrylonitrile.

3. A pile composition as defined in claim 1 or 2 wherein the shrinkable fibers have an organopolysiloxane deposited on the surface thereof.

4. A pile composition as defined in claim 3 wherein the organopolysiloxane contains an epoxy group.

5. A pile composition as defined in claim 3 wherein the organopolysiloxane contains an amino group.

* * * * *

UNITED STATES PATENT AND TRADEMARK OFFICE

CERTIFICATE OF CORRECTION

PATENT NO. : 4,576,840

DATED : March 18, 1986

INVENTOR(S) : MURATA, et al.

It is certified that error appears in the above-identified patent and that said Letters Patent is hereby corrected as shown below:

Column 5, line 58, "KANEKALON" should read -- KANECARON --.

Column 5, line 68, "KANEKALON" should read -- KANECARON --.

Column 6, line 62, "KANEKALON" should read -- KANECARON --.

Column 7, line 20, "KANEKALON" should read -- KANECARON --.

Column 7, line 44, "KANEKALON" should read -- KANECARON --.

Column 7, line 56, "KANEKALON" should read -- KANECARON --.

Column 8, line 8, "KANEKALON R" should read -- KANECARON ® --.

Signed and Sealed this

*Second* Day of *September 1986*

[SEAL]

*Attest:*

*Attesting Officer*

DONALD J. QUIGG

*Commissioner of Patents and Trademarks*